United States Patent [19]

Beck

[11] Patent Number: 4,475,260

[45] Date of Patent: Oct. 9, 1984

[54] PIPELINE SERVICING TOOL

[76] Inventor: Richard D. Beck, P.O. Box 7247, Salem, Oreg. 97303

[21] Appl. No.: 462,528

[22] Filed: Jan. 31, 1983

[51] Int. Cl.[3] ..... B08B 9/02

[52] U.S. Cl. ..... 15/104.12; 15/104.3 R

[58] Field of Search ..... 15/104.05, 104.09, 104.12, 15/104.13, 104.3 R

[56] References Cited

U.S. PATENT DOCUMENTS

| | | | |
|---|---|---|---|
| 2,062,850 | 12/1936 | Weaver et al. | 15/104.3 R |
| 3,562,836 | 2/1971 | Frew et al. | 15/104.3 R |
| 4,011,100 | 3/1977 | Ross | 15/104.12 X |

FOREIGN PATENT DOCUMENTS

| | | | |
|---|---|---|---|
| 2384129 | 11/1978 | France | 15/104.12 |
| 519522 | 7/1976 | U.S.S.R. | 15/104.12 |

*Primary Examiner*—Edward L. Roberts

[57] ABSTRACT

A liquid operated motor assembly has an exterior housing arranged to be driven rotatably by fluid pressure. The exterior housing has a cutter at its leading end which is dimensioned and arranged to clear a path through a pipe at least as large in cross section as trailing portions of the motor assembly. The motor assembly is connected at its trailing end to radially expandable links arranged when expanded to engage the inner surface of a pipe and stabilize the position of the motor assembly and arranged when retracted to allow retrieval of the tool through a bore made by the cutter. Operation of the expanding links is accomplished by a fluid operated cylinder assembly in the same circuit as the motor whereby to be expanded when the motor is in operation. Fluid supply for the motor includes forwardly directed orifices that clean debris away from the front of the tool. The discharge outlet for the motor is located within the cutter housing so that discharged fluid cools the cutter.

9 Claims, 5 Drawing Figures

PIPELINE SERVICING TOOL

BACKGROUND OF THE INVENTION

This invention relates to new and useful improvements in pipeline servicing tools and is more particularly concerned with a tool arranged to be moved through a pipeline for clearing obstructions therefrom.

Pipeline servicing tools have heretofore been provided for clearing obstructions from pipes or the like. One desirable feature of this type of tool is that it be capable of being moved positively in a stabilized condition in the pipe and preferably a non-rotatable positioning so that lines leading thereto are not wound and fouled. Another feature that is desirable in this type of tool is that it not only be capable of reaming out a passageway in pipelines but also that it can cut away tree roots and stub ends of laterals that project into the pipeline. Another desirable feature is that this tool be capable of movement through a pipeline without fouling and can be readily withdrawn if necessary.

SUMMARY OF THE INVENTION

According to the present invention and forming a primary objective thereof, a pipeline servicing tool is provided which is capable of having a stabilized non-rotative support in a pipeline and which is capable of effectively reaming out a pipeline including the cutting of tree roots, stub ends of laterals, and other obstructions, and also is capable of movement in a pipeline without fouling including a withdrawing movement thereof.

Another object of the invention is to provide a pipeline servicing tool capable of flushing away debris in its path.

Another object of the invention is to provide a pipeline servicing tool having fluid cooling means for the cutting bit and more particularly to use discharged fluid from a fluid drive motor of the tool as the cooling medium.

In carrying out the objectives of the invention, a fluid operated motor assembly has connector means arranged for association with ground supported equipment to move the tool through a pipeline. The motor assembly includes a rotating housing motor having cutting means on the leading edge of the housing. Such cutting means is arranged to clear a path through a pipe at least as large in cross section as trailing portions of the motor assembly to allow the unit to be readily retracted if desired. The motor assembly supports a fluid operated cylinder assembly on its trailing end having radially expandable link means. The fluid operated cylinder assembly is in circuit with the fluid drive motor and operates simultaneously with the motor assembly. The expandable link means stabilizes the tool interiorly of the pipe and has end wheels for rolling engagement on the interior surface of the pipe. Stabilizing wheels are also provided on the leading end of the motor assembly. Connector means for connecting the tool to the ground equipment includes a conduit-like member secured to the motor assembly for supplying fluid pressure to the motor assembly as well as providing a pulling connection. This conduit-like connector includes a nozzle at the leading end of the tool for directing some of the pressured fluid forwardly to wash debris ahead of the tool. The rotatable housing is tubular in construction and is open at the leading end, the open defining edge of this housing having cutting teeth. The discharge outlet for expended driving fluid from the motor empties into this hollow housing and cools the cutting bit.

The invention will be better understood and additional objects and advantages will become apparent from the following description taken in connection with the accompanying drawings.

DETAILED DESCRIPTION OF A PREFERRED EMBODIMENT

Figure 1:
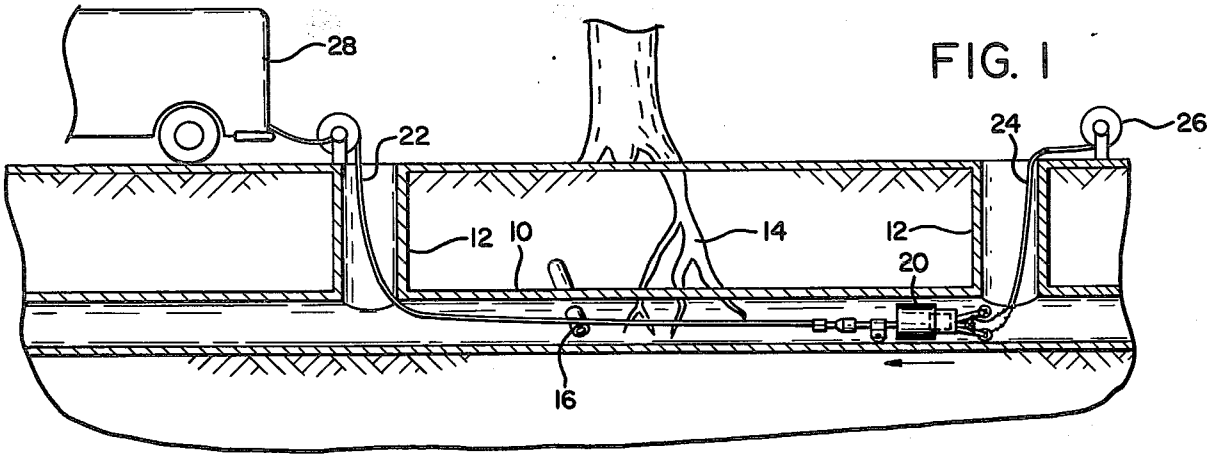
FIG. 1 is a diagrammatic view of a typical pipeline and showing the present tool in a working condition in the pipeline.

With reference to FIG. 1, the numeral 10 designates a conventional pipeline having access holes 12 which may be existing or which may have to be provided for operation of a servicing tool, such as the present tool. Frequently, pipelines of this type become plugged and require reaming, and in addition, the pipe often has hard to remove obstructions such as tree roots 14, lateral pipe ends 16 which project a short distance into the pipeline, and other obstructions.

The tool of the present invention is designated generally by the numeral 20 and is shown in FIG. 1 in a working position in the pipeline. A pull line 22 extends through one of the access holes 12 and is attached to the front or leading end of the tool. A retrieving line 24 is attached to the other end of the tool and may be associated with a winch 26 or the like. The pull line 22 includes fluid supply and conduit means from a suitable winch and pressure source 28 such as a service vehicle.

Figure 2:
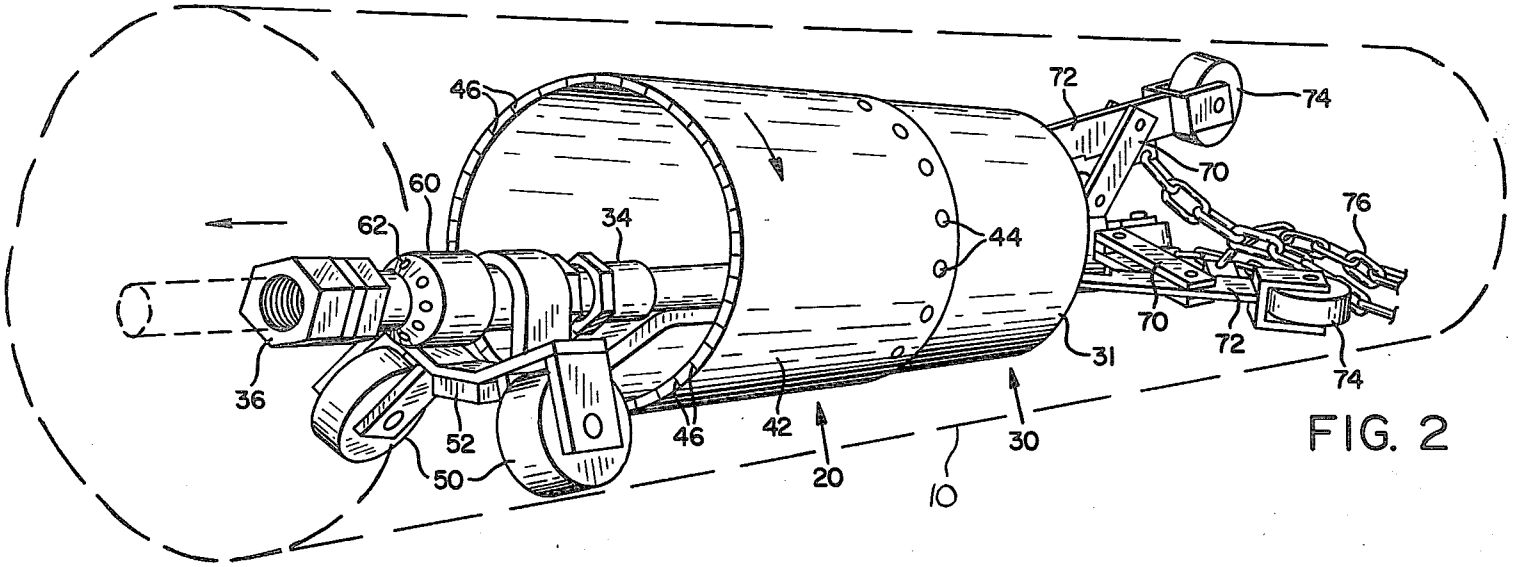
FIG. 2 is an enlarged front perspective view of the present tool.
Figure 4:
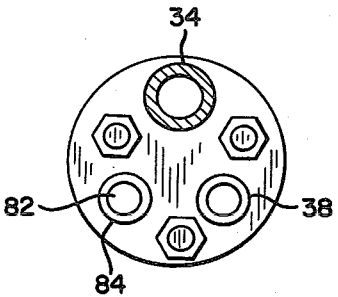
FIG. 4 is an enlarged fragmentary sectional view taken on the line 4—4 of FIG. 3.
Figure 3:
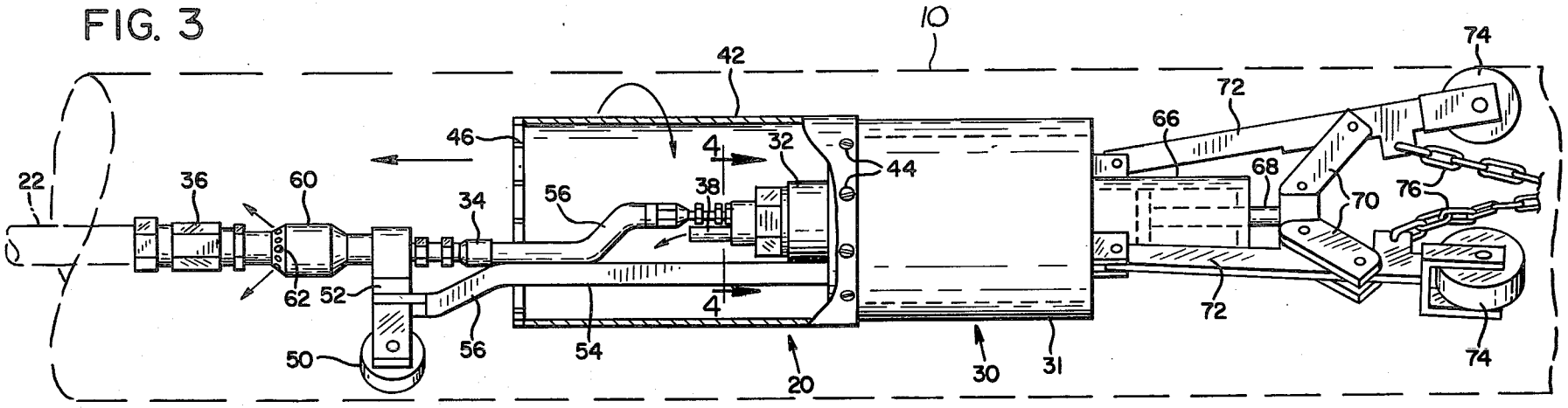
FIG. 3 is a side elevational view of the tool, a portion of this view being broken away.

With particular reference to FIGS. 2 and 3, the tool comprises a fluid operated motor 30. In particular, such motor comprises a conventional rotatable housing motor wherein an outer housing 31 is driven rotatably on a stationary core 32. According to the invention, fluid supply for the motor is through a conduit-like connector or tongue 34 having a releasable securement to the pull line 22 by a suitable fitting 36. Conduit-like connector 34, also seen in FIG. 4, leads into the core of motor 32 for transmitting the pressured fluid, the motor having a discharge outlet 38.

The cutting portion of the tool comprises a tubular housing 42 having open ends. One end of this housing is releasably secured to the motor housing 31, as by screws 44, and the other end of this housing has cutter teeth 46 around the defining front edge thereof. Housing 42 encloses a portion of the connector 34 and also encloses the discharge outlet 38 from the motor 30 whereby discharged fluid produces a cooling effect on the cutter 46.

A pair of flared support wheels 50 are mounted on a chassis frame 52 secured to the member 34 and braced by a longitudinal arm 54 integrated with the wheel frame 52 and motor core 32. The connector 34 and reinforcing arm 54 are offset downwardly at 56 whereby with the wheels 50 riding along a bottom portion of the pipeline, the motor 30 is substantially centered in the pipeline.

Member 34 has a nozzle portion 60 forward of the wheels 50 with outlet orifices 62 directed forwardly. The interior of the nozzle 60 and the outlet orifices 62 are in communication with the hollow fluid transmitting connector 34, whereby a portion of the pressured fluid in the member 34 for driving the motor 30 is discharged through the orifices 62, for a purpose to be more fully explained hereinafter.

The trailing end of motor core 32 integrally supports a fluid operated cylinder-assembly 66 the piston rod 68 of which projects rearwardly and is pivotally secured to one end of three pairs of links 70. The other end of these links is pivotally connected to an intermediate portion of longitudinally extending arms 72 pivotally connected at one end to the non-rotative core portion of motor 30. Links 70 have wheels 74 supported on their free ends. The linkage 70 and arms 72 are arranged such that upon actuation of the fluid operated cylinder 66 the outward movement of piston rod 68 spreads the arms 72 into contact with the pipe. A pull chain 76 is attached at one of its ends to arms 72 and at its other end to retrieving line 24.

Figure 5:
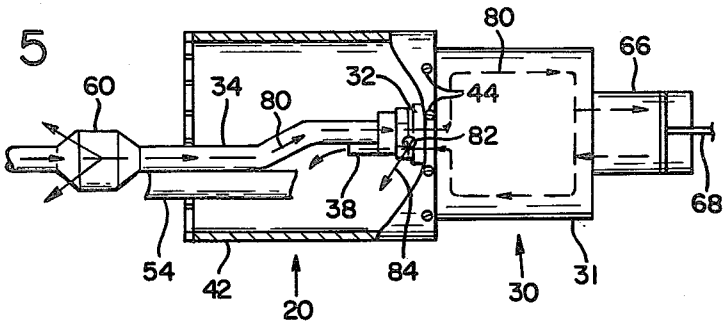
FIG. 5 is a fragmentary diagrammatic view showing the fluid operating circuit of the tool.

The inlet to the fluid operated cylinder 66 is connected into communication with the fluid drive area of the motor 30 and the discharge from such cylinder is in communication with the discharge of the motor, whereby the fluid operated cylinder 66 is actuated simultaneously with actuation of the motor 30 and the stabilizing arms 72 expand outwardly for centering the assembly within the pipe as soon as the motor is actuated. The cylinder 66 will remain actuated as long as the motor is driving. More particularly, and with reference to FIG. 5, the liquid drive path through the member 34 and motor 30 is designated diagrammatically by the broken line 80, comprising an inlet path through the connector 34, into the motor 30, and then discharged through outlet 38. The circuit 80 also passes to the fluid operated cylinder assembly 66 for actuation of the stabilizing arms 72. A portion of the driving fluid is also discharged through the orifices 62 to wash debris ahead of the tool, and for this purpose the outlet flow through these orifices is less than the input volume whereby the motor 30 and cylinder 66 are supplied with suitable pressure and the outlet of fluid through orifices 62 is sufficient to develop an effective stream for washing debris ahead of the tool. A relief valve 82, FIG. 5, is provided at the front of the motor 30 to prevent overpressurizing of the motor and has a discharge outlet 84 into the cutter housing 42.

In the operation of the tool, it is placed in the pipeline, as shown in FIG. 1, with suitable connection to the pull line 22 and retrieving line 24. Fluid pressure is applied in pull line 22 and such line is also tensioned to move the tool forward through the pipe. The fluid pressure in this line drives the cutting portion of the motor and also stabilizes it by expansion of arms 72. The forward cutting edge 46 reams out the pipe and also grinds through any obstructions such as roots and stub ends of laterals. The tool can be retrieved through the access hole adjacent to the service 28 or if desired it can be retrieved by means of line 24. When retrieving the tool by line 24, the pressure in line 22 is shut off, whereby the stabilizing means 72 retract to allow the tool to readily move rearwardly in the bore that it has made. Such retrieving movement is possible since the cutter cleans a path at least as large as trailing portions of the assembly.

The size of the bore can be increased simply by substituting a larger cutter housing 42 and of course a longer wheel assembly 50. Also, the links 70 will allow expansion for larger pipes, or if necessary, longer links can be installed.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. The pipeline servicing tool arranged to be pulled through a pipeline and arranged for connection to a pressured liquid source, said tool comprising (a) a fluid driven motor assembly having leading and trailing ends and having a drive portion, (b) connector means on said motor assembly for moving it through a pipe to be cleaned, (c) an exterior tubular housing on said motor assembly arranged to be driven rotatably on said motor assembly by fluid pressure, (d) said housing having an open leading end into which said connector means extends for securement to said motor assembly, (e) said leading end comprising a circular toothed cutting edge, (f) fluid transmitting means connected to said motor assembly for admitting pressured liquid to said motor assembly from a pressured liquid source, (g) said cutting edge being dimensioned and arranged to clear a path through a pipe larger in diameter than trailing portions of said motor assembly.

2. The pipeling servicing tool of claim 1 including a fluid operated cylinder assembly secured on the trailing end of said motor assembly, and radially expandable and contractible link means connected to said fluid operated cylinder assembly arranged to be expanded against the interior of a pipe when said cylinder assembly is supplied with fluid pressure to stabilize said tool interiorly of a pipe, said link means in the contractible condition thereof being smaller in diameter than said cutting edge.

3. The pipeline servicing tool of claim 1 including a fluid operated cylinder assembly secured on the trailing end of said motor assembly and being connected into the fluid driving portion of said motor whereby said cylinder assembly is actuated concurrently with the actuation of said motor assembly, and radially expandable and contractible link means connected to said fluid operated cylinder assembly arranged to be expanded against the interior of a pipe when said cylinder assembly is supplied with fluid pressure to stabilize said tool interiorly of a pipe, said link means in the contractible condition thereof being smaller in diameter than said cutting edge.

4. The pipeline servicing tool of claim 1 including a fluid operated cylinder assembly secured on the trailing end of said motor assembly, radially expandable and contractable link means connected to said fluid operated cylinder assembly arranged to be expanded when said cylinder assembly is supplied with fluid pressure, and wheel means on the end of said link means arranged for rolling engagement with the interior surface of a pipe when said link means is expanded to stabilized said tool interiorly of a pipe, said link means in a contractible condition thereof being smaller in diameter than said cutting edge.

5. The pipeline servicing tool of claim 1 including a fluid operated cylinder assembly secured on the trailing end of said motor assembly, radially expandable and contractible link means connected to said fluid operated cylinder assembly arranged to be expanded when said cylinder assembly is supplied with fluid pressure, wheel means on the end of said link means arranged for rolling engagement with the interior surface of a pipe when said link is expanded to stablilize said tool interiorly of a pipe, said link means in the contractible condition thereof being smaller in diameter than said cutting edge, and stabilizing wheel means on the leading end of said motor assembly.

6. The pipeline servicing tool of claim 5 wherein said connector means is secured to the leading end of said motor assembly for pulling the assembly through a pipe, and means on the trailing end of said motor assembly arranged for connection to a retrieving line.

7. The pipeline servicing tool of claim 1 wherein said connector means comprises a conduit-like member establishing communication between said motor assembly and a pressured liquid source.

8. The pipeline servicing tool of claim 1 wherein said connector means comprises a conduit-like member establishing communication between said motor assembly and a pressured liquid source, said conduit-like member also comprising a tongue arranged to be connected to a pulling source.

9. The pipeline servicing tool of claim 1 wherein said connector means comprises a conduit-like member establishing communication between said motor assembly and a pressured liquid source, and nozzle means in said conduit-like member directing some of the pressured liquid interiorly of a pipe at the leading end of said motor assembly to wash debris ahead of said tool.

* * * * *